US009078546B2

(12) United States Patent
Kaufmann

(10) Patent No.: US 9,078,546 B2
(45) Date of Patent: Jul. 14, 2015

(54) DISPENSER FOR MOIST WIPE MATERIAL, A WEB OF MATERIAL FOR USE THEREIN AND FLUTED ROLLER

(75) Inventor: Werner Kaufmann, Buchs (CH)

(73) Assignee: Audag AG, Root (CH)

( * ) Notice: Subject to any disclaimer, the term of this patent is extended or adjusted under 35 U.S.C. 154(b) by 710 days.

(21) Appl. No.: 13/142,044

(22) PCT Filed: Nov. 25, 2009

(86) PCT No.: PCT/EP2009/008393

§ 371 (c)(1),
(2), (4) Date: Sep. 9, 2011

(87) PCT Pub. No.: WO2010/072298

PCT Pub. Date: Jul. 1, 2010

(65) Prior Publication Data

US 2011/0308451 A1 Dec. 22, 2011

(30) Foreign Application Priority Data

Dec. 24, 2008 (WO) ..... PCT/EP2008/011118

(51) Int. Cl.
*B65H 20/02* (2006.01)
*B65H 20/20* (2006.01)
(Continued)

(52) U.S. Cl.
CPC ..... *A47K 10/32* (2013.01); *A47K 2010/3286* (2013.01)

(58) Field of Classification Search
USPC ..... 242/564, 564.1, 564.3, 564.4, 565, 579, 242/580
See application file for complete search history.

(56) References Cited

U.S. PATENT DOCUMENTS 4,960,248 A * 10/1990 Bauer et al. ..... 242/564.4
7,185,841 B2 * 3/2007 Kaufmann ..... 242/564.4
(Continued)

FOREIGN PATENT DOCUMENTS

AU 552877 B2 6/1986
DE 196 03 206 A1 7/1996
(Continued)

*Primary Examiner* — Emmanuel M Marcelo
*Assistant Examiner* — Angela Caligiuri
(74) *Attorney, Agent, or Firm* — Kilpatrick Townsend & Stockton LLP

(57) ABSTRACT

A dispenser for moist wipe material comprises a support member carrying a holder for a supply of material, a reservoir for a moistening fluid, a tank for dispensing moistening fluid into the fluid reservoir to maintain a desired level of fluid therein, a first roller disposed in the reservoir and having a first surface region dipping into the reservoir to a depth below said level, a means for driving the first roller to transport moistening fluid from the reservoir to material contacting a second surface region of the first roller spaced from said first region and a second roller for pressing the web of material onto the first roller. In this design a section of said material overlies an opening in a wall of said reservoir and contacts said second surface region and said second roller is disposed in a housing adapted to seal against said wall of said reservoir around said opening with said second roller pressing said section of material into contact with said second surface region and said material being engaged by said housing and said wall upstream and downstream of said opening with a force permitting the transport of said material between said housing and said wall on driving of said first roller. A web of material having cut-outs and a special design of fluted roller are also claimed.

22 Claims, 13 Drawing Sheets

(51) Int. Cl.
*B65H 51/04* (2006.01)
*A47K 10/32* (2006.01)

(56) References Cited

U.S. PATENT DOCUMENTS 8,146,471 B2 * 4/2012 Hansen et al. ..... 83/337
8,177,156 B1 * 5/2012 Rinne ..... 242/564.4
2001/0001475 A1 * 5/2001 Formon et al. ..... 242/563.2

FOREIGN PATENT DOCUMENTS

DE 298 12 501 U1 2/1999
EP 1 273 254 A2 1/2003
GB 2 168 031 A 6/1986
WO WO 03/047410 A1 6/2003

* cited by examiner

DISPENSER FOR MOIST WIPE MATERIAL, A WEB OF MATERIAL FOR USE THEREIN AND FLUTED ROLLER

CROSS-REFERENCES TO RELATED APPLICATIONS

This application is a National Stage of International Application No. PCT/EP2009/008393 filed Nov. 25, 2009, and which claims the benefit of European Application No. PCT/EP2008/011118, filed Dec. 24, 2008, the disclosures of which are incorporated herein by reference.

BACKGROUND OF THE INVENTION

The present invention relates to a dispenser for moist wipe material comprising a support member carrying a holder for a supply of material, a reservoir for a moistening fluid, a tank for dispensing moistening fluid into the fluid reservoir to maintain a desired level of fluid therein, a first roller disposed in the reservoir and having a first surface region dipping into the reservoir to a depth below the level, a means for driving the first roller to transport moistening fluid from the reservoir to material contacting a second surface region of the first roller spaced from the first region and a second roller for pressing the web of material onto the first roller.

A dispenser of this kind is described, for example in WO 03/047410 A1. The dispenser shown there includes a roll of dry toilet paper and a further roll of hygiene paper which can be moistened. The dispenser can be realized with both the dry toilet paper and hygiene paper or can be used solely for dispensing hygiene paper.

Despite its advantageous design with regard to the transport of the hygiene paper and the ability to moisten the hygiene paper without the hygiene paper tearing due to it loosening strength when wet, the known dispenser is not really suitable for use with a fluid medium which contains volatile components or is itself volatile. By way of example, the present invention recognizes that there is a need to provide a dispenser capable of dispensing moist wipe material moistened with an alcohol/water mixture, such as is used by medical personnel for cleaning their hands to ensure these are hygienically sterile. Such water/alcohol mixtures typically contain water/propanol in a 50/50 mixture. Since a tank of this mixture and the fluid reservoir that is connected to it can last for a relatively long period of time, a significant problem arises in that the alcohol component vaporizes and the strength of the mixture gradually decreases over time which is not acceptable from the point of clinical practice. Similar problems can also occur if the fluid is, for example, a usual organic solvent, such as methanol or brake-cleaning fluid. In either case, vaporization of the fluid leads to a loss of fluid and could, in a critical environment, even constitute a fire hazard. It is therefore a first object of the present invention to provide a modified dispenser which is able to operate with fluids containing volatile components or volatile fluids per se which makes it possible to significantly reduce the loss of the readily vaporizable component from the mixture or the loss of the vaporizable fluid per se, but which does not impair the transport of the material through the dispenser in particular in the area of the first and second rolls, and which simultaneously represents a simple and readily practical design which can be manufactured at relatively advantageous cost and which is simple to use and reliable in use and prevents unwanted tearing of the moist wipe material. Moreover, it is desirable to provide a dispenser which can prevent unwanted contamination of the moistening fluid

BRIEF SUMMARY OF THE INVENTION

A further object of the present invention is to provide an improved web of paper for use in such an improved dispenser, with the web of paper facilitating the control of the dispenser to advance pre-specified lengths of moistened material each time it is activated.

It is a yet further object of the present invention to provide a roller suitable for use in a dispenser which contributes to avoiding fluid loss and nevertheless ensures a very effective wetting of the material when set in rotation, but does not otherwise significantly wet the material and which can readily be designed to achieve the desired degree of moistening of the web in use.

In order to satisfy these objects there is provided, in accordance with the present invention, an improved dispenser of the initially named kind which is characterized in that, in use of the dispenser, a section of the material overlies an opening in a wall of the reservoir and contacts the second surface region and the second roller is disposed in a housing adapted to seal in relation to the wall of the reservoir around said opening with the second roller pressing the section of material into contact with the second surface region and the material being engaged on opposite sides by the housing and the wall upstream and downstream of the opening with a force permitting the transport of the material between the housing and the wall on driving of the first roller.

By incorporating the second roller in a housing, which can for example be carried by a part, optionally in the form of a hood, covering the supply of material and pivotable away from the support member, for example about a horizontal axis, it is possible to open the dispenser to allow a length of the material to be placed behind the part in front of the reservoir, typically in a vertical gap between the first and second rollers and between the housing and the wall of the reservoir but to shut the part or hood again so that the housing essentially seals the reservoir relative to the outside environment. The part typically has a rounded edge or a roller acting as a deflecting member for the material on its path from the supply to the nip formed between the first and second rollers when the part or hood is closed. This path can for example change from a generally vertical direction upstream of the deflecting member to a generally horizontal direction downstream thereof in the run-in to the nip.

The only path which is theoretically available for the escape of volatile fluid in vapour form is through the pores or interstitial spaces of the thin material strips upstream and downstream of the opening in the wall of the reservoir. However, it was surprisingly found that, even with a modest pressure of, for example, one Newton to five or ten Newtons for a material (for example a paper web) width of 200 mm, the housing seals so well against the wall of the reservoir outside of the layer of material and against the material that the fluid losses are negligibly small. Nevertheless, the ability to dispense the material between the housing and the wall of the reservoir is maintained.

The part or hood can have a carrier member adapted to carry the housing and means is preferably provided for generating relative movement between the housing and the carrier member for urging the housing into contact with the wall of the reservoir.

The first roller is preferably a fluted roller, in particular a fluted roller designed as explained later in relation to FIGS. 6 and 7 and the second roller is preferably a roller of resilient material such as silicone having a shape substantially complementary to that of the first roller. Such a design ensures that fluid cannot pass from the level of the reservoir to the material when the rollers are stationary but only when the first and second rollers are rotating. Moreover, the nipping of the material between the peaks of the flutes of the first roller and the bases of the corresponding flutes of the second roller can be exploited to prevent wicking of the fluid into the material when the rollers are rotating.

The material is conveniently present in the form of one of the following: a roll of material, material in fan-fold form, material in web form with or without perforations, a web of material having notches cut-outs and/or printing marks at one or more side regions thereof and at substantially uniform intervals and material in discrete sheet form, optionally with perforations at the side for sheet feeding. Material in Roll form is preferred since this is easy to handle.

The wall of the reservoir against which the housing seals is preferably a top wall, however, this is not essential, it could also be a sloping front wall (for example).

To generate the nipping force between the housing and the wall of the reservoir a solenoid is preferably used which is adapted to resiliently urge the housing into engagement with the wall of the reservoir with a predetermined force. Such a solenoid can be a type of solenoid known per se having two rest positions for its armature at least one of which is resilient but both of which are stable positions when the solenoid is not electrically energised. Electrical energisation is only required to move the armature between the two rest positions. This saves power consumption when the dispenser is in a waiting mode (waiting for a user to require the issue of a further length of moist wipe material) and contributes to permitting battery operation of the dispenser, which could however alternatively be fed from a mains power supply if required.

In some cases, depending on the nature of the material to be moistened it is expedient to provide a means for urging the second roller in the direction towards the first roller. One convenient design of such a means can comprise spring-loaded plungers extending in sealed manner through the housing and contacting ends of the second roller.

It is also convenient if the material comprises a continuous web of material having perforations, cut-outs, marks or markings at predetermined intervals in at least one marginal region of the web and if the dispenser has at least one detection sensor adopted to detect the cut-outs, perforations, marks or markings and to trigger the means for driving the first roller to stop further transport of the web of material. This greatly simplifies the design of the electronic control circuitry for driving the motor used to drive the first roller. The drive motor can namely be started by a trigger signal received when an operator places his hand in an issue region for the moist wipe material and stopped when the next cut-out, perforation mark or marking reaches the detection sensor, which sends a stop signal to the motor. By predetermining the spacing of the cut outs, perforations, marks or markings along the web of material a desired preset length of moist wet wipe material can be reliably issued. If the operator requires more waste wipe material he can reach again into the field of view of the sensor issuing the trigger signal to start the issuing process.

It is also possible to provide a series of closely spaced cut-outs, perforations, marks or markings and to be able to program the control to issue any desired multiple of a basic length of moist wipe material. A basic dispenser can thus easily be programmed to suit an individual operators needs. Such a system can also be used to carry out a progressive count of the lengths of moist wipe material issued and thus to estimate when the supply of material will require replenishing and to issue a warning of some kind, for example to light up a red diode alerting the operator of the need to replenish the supply.

The invention also relates to a web of paper having cut-outs, perforations and/or other marks or markings at at least one side margin of the web and disposed at regular intervals for use in a dispenser and adapted to trigger a sensor to issue a trigger signal on passage of the cut-outs, perforations or other marks or markings past a suitable sensor, for example a light barrier or an optical, capacitive, inductive or magnetic sensor, or any other suitable sensor.

Thus the dispenser preferably includes a sensor disposed in the area of issue of the material from the dispenser and adapted to detect the presence of a hand or of hands of an operator and to start the means for driving the first roller to transport the material towards the operator.

The first roller can either be driven directly or via a gear located outside of the reservoir and attached to a shaft of the first roller extending through a seal into the reservoir, or indirectly via the second roller, the second roller then being connected directly or via a transmission to a motor disposed exterior to the reservoir.

In a particularly important embodiment, a second set of rollers is arranged within the dispenser to securely guide the material from the first set of rollers to a slot in the housing after the material has been moistened. This second set of rollers enables an even more secure guidance of the material after it has been moistened and enables a safer dispensing of the material to a user, i.e. it prevents the material from being torn off wrongly at the tear-off fins.

The moistening fluid can, for example, comprise any one of an alcohol/water mixture for sterilization purposes, a sterilizing medium, a solvent for cleaning purposes, a brake cleaning medium, a paint cleaning medium, a cleaning medium for any other purposes and a cosmetic medium, the cosmetic medium and/or the cleaning medium optionally including scented and/or perfumed mixtures.

The present invention also relates to a fluted roller having longitudinal grooves or flutes arranged at regular angular intervals around the roller preferably generally parallel to the axis thereof with adjacent grooves (flutes) merging into one another at longitudinal peaks of the fluted roller, with each groove or flute being of generally arcuate shape at its base between each adjacent pair of peaks.

In a preferred embodiment the fluted roller preferably has an outer diameter in the range between 10 and 25 mm, preferably between 12 and 18 mm and in particular of approximately 15 mm, the number of grooves is expediently selected to lie in the range between 6 and 60, in particular between 18 and 36 and is preferably approximately 24, with the arcuate bases of the grooves having a radius in the range from 0.5 mm to 3.0 mm and/or the individual grooves or flutes have a maximum depth measured radially from an imaginary pitch circle on which the peaks between the flutes lie to the base of the grooves of 0.5 to 1.0 mm, preferably 0.7 mm and with the included angle of each peak of the fluted roller measured between the tangents to each side of each peak lying in the range from 30° to 20° and in particular at 27° and/or in that the second roller is of generally complementary shape but optionally with a diameter different from that of the first roller and with a radial depth of each groove of the second roller being greater than the corresponding depth of each groove of the first roller, for example by an amount in the range from 0.2 mm to 0.6 mm.

Finally the fluted roller can expediently be provided with radially extending grooves arranged at intervals along the length of the first roller and separating sections of longitudinal grooves having the described shape. This embodiment makes it possible to control the amount of moistening fluid used to moisten the wet wipe material for a given speed of rotation of the first roller. Surplus fluid namely collects in the grooves and drips bank into the reservoir for reuse.

The dispenser which is preferably provided with a fluted roller as described is preferably equipped with a second roller of resilient material having a shape substantially complementary to that of the first roller.

BRIEF DESCRIPTION OF THE DRAWINGS

The invention will now be described in more detail with reference to an embodiment as shown in the accompanying drawings in which.

DETAILED DESCRIPTION OF THE INVENTION

Figure 1:
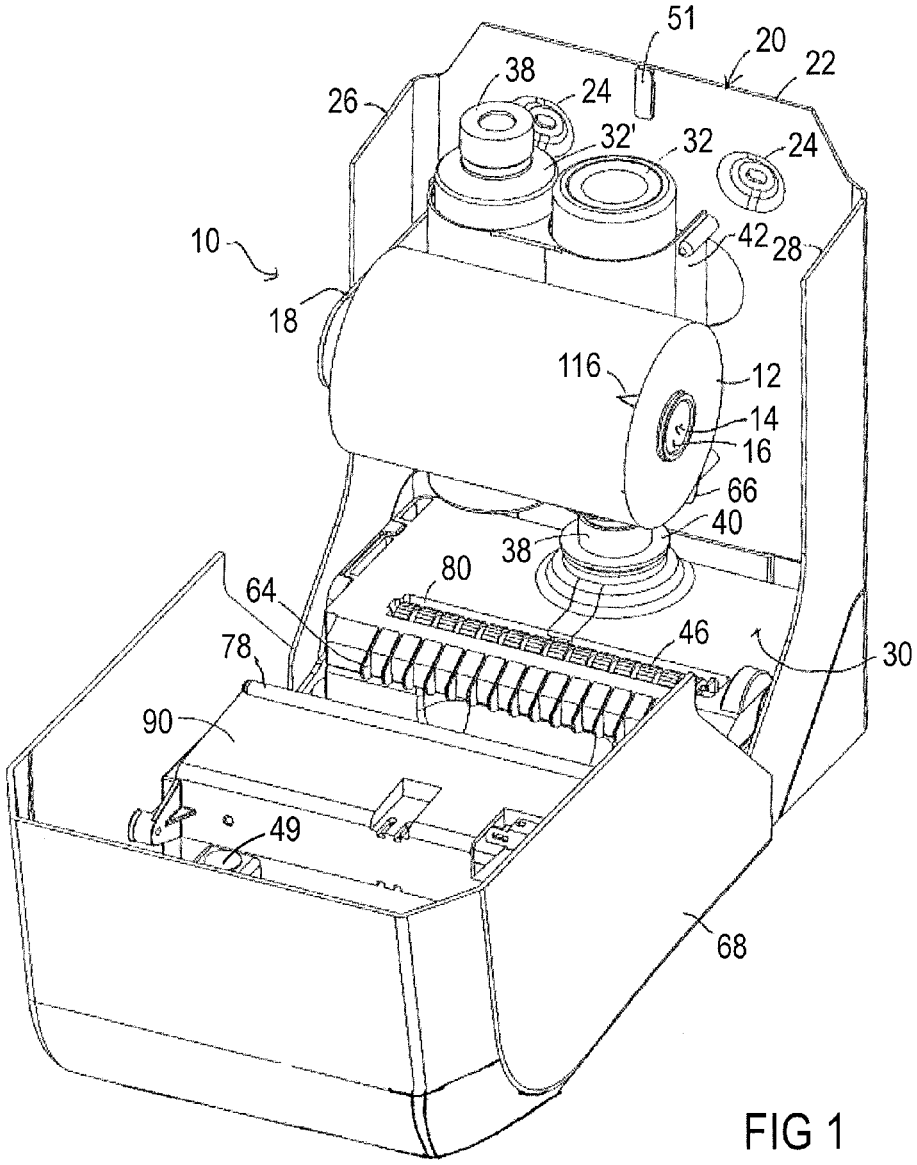
FIG. 1 shows a perspective view of a dispenser with the hood which normally covers the roll of papers swung downwardly.
Figure 2:
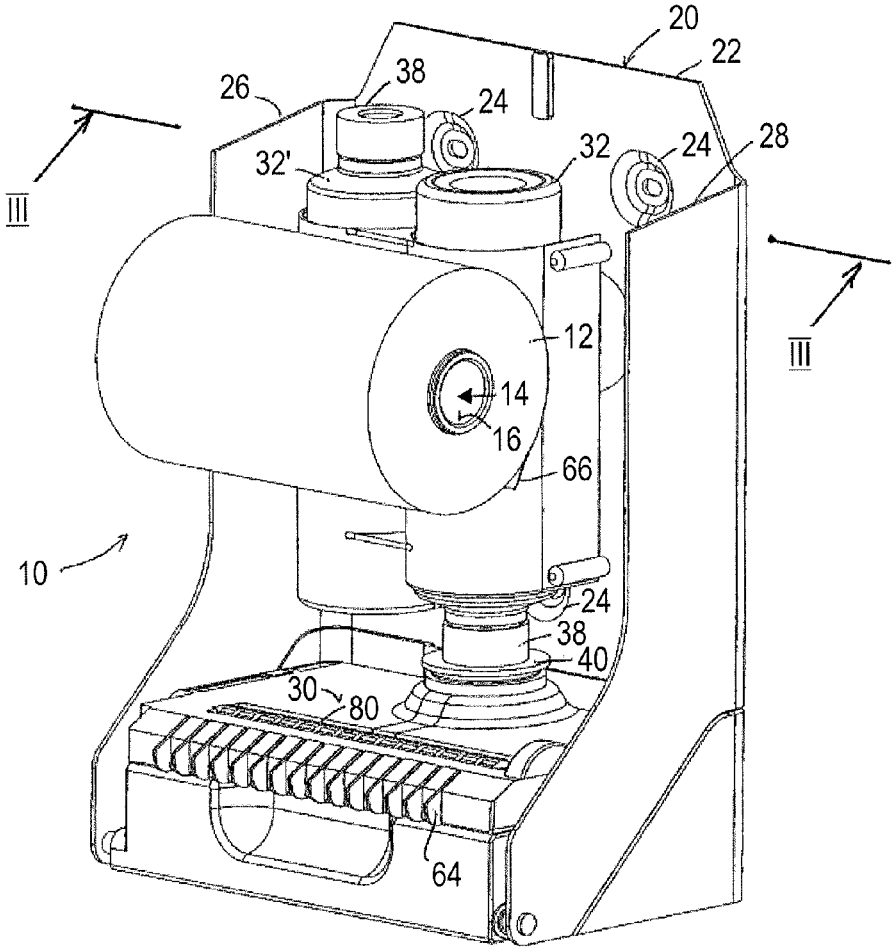
FIG. 2 shows a perspective view of the apparatus of FIG. 1 with the hood removed.

Turning first of all to FIGS. 1 to 5, reference is first made to FIG. 1 which shows a general perspective view of a dispenser 10 for moist wipe material. The moist wipe material 12 is initially present in the form of a roll of dry paper 12 present on a holder 14 and is subsequently moistened/wetted. The holder 14 is formed by a tube member 16 secured to a bracket 18 in the form of a plate which is secured (optionally pivotably secured about a vertical axis for easy access) to a support member 20 forming the backbone of the dispenser 10. The support member 20 in this embodiment takes the form of a stainless steel plate which has a back part 22 with holes 24 for mounting the dispenser on a wall and two side limbs 26 and 28 which enclose the inner components of the dispenser from the sides. It should be noted that this design of the support member is just one possible arrangement. Instead of using a stainless steel plate or pressing it could be a plate or pressing of another metal, optionally in powder coated form, or an injection molded plastic part or simply a frame. The precise shape is simply a matter of choice and expediency. Another possibility (not shown) is for the support member 20 to be provided with a horizontal base portion so that the dispenser can stand on a table or the like.

Irrespective of the precise design of the support member 20 it expediently carries the holder 14 for the supply of material 12, a reservoir 30 for a moistening fluid and a tank 32 for dispensing moistening fluid into the fluid reservoir 30 to maintain a desired level 34 (FIG. 5) of fluid therein. For this purpose the tank 32, which comprises an interchangeable cylindrical flask of the desired fluid is provided with a valve arrangement 36 at the bottom which can be seen to a larger scale in FIG. 4A and which automatically opens when the level 34 of fluid in the reservoir sinks below the predetermined level 34 to replenish the reservoir to the level 34. More specifically, the tank 32 has a cylindrical threaded neck 38 onto which the valve 36 is screwed. The valve 36 has a radially extending flange 36A which sealingly engages the lip of a lip seal 40 surrounding the valve arrangement 36 and mounted on the top of the reservoir to prevent vapor from the cleaning fluid in the reservoir escaping from the tank. The lip of the lip seal 40 is made so that it can deflect through a relatively wide range so that sealing is always effected, irrespective of the precise distance between the flange 36A and the bottom edge 36B of the valve 36 which sits on the rim 36C of an upwardly open cup member 36D with apertures in its sides. In the transverse base portion 36E of the valve 36 there is a poppet valve with a head portion 36F which can sealingly engage a seal 36G on the base portion 36E. When not in use the valve is normally sealed. For this purpose a spring can be provided (not shown and not essential) to keep the head portion 36F in contact with the seal 36G. When the tank 32 is in use the stem 36H of the poppet valve contacts a central post 36*l* of the cup member 36D and the head portion is lifted from the seal 36G allowing liquid to flow from the tank 32 through the apertures in the sides of the cup into the reservoir. Flow continues until the level of fluid in the reservoir reaches the level of the bottom edge 36B of the valve. Thereafter a partial vacuum is created in the tank 32 and flow stops. When fluid is taken from the reservoir and the level drops therein further flow takes place from the tank into the reservoir until the level of the bottom edge 36B, i.e. of the rim 36C, is reached again. Thus the level of fluid in the reservoir is always maintained at 34 until the tank 32 is empty and has to be replaced with a new bottle of fluid onto which the valve 36 can be screwed. The cup member 36D can be made removable to permit possible cleaning if required. In an alternative design a solenoid operated valve can be used. This can for example be of advantage if the dispenser is used in an ambulance where motion of the ambulance could unsteady the mechanical valve of FIGS. 4 and 4A resulting in undesired fluid flow from the tank 32.

The reference numeral 32' refers to a second tank provided as a replacement for the first so that the tanks 32, 32' can readily be exchanged once the tank 32 runs dry. If desired a further reserve tank (not shown) could be provided to the right of tank 32 in FIG. 1. The tanks 32 and 32' sit in a separate holder 42 connected to the rear wall 22 of the support member 20.

Located within a trough 44 forming an integral part of the reservoir 30 and in fluid communication with the interior of the reservoir 30 there is a first roller 46 disposed in the reservoir and having a first surface region 48 dipping into the reservoir 30 to a depth below the preset fluid level 34. In this embodiment the first roller 46 is driven by a DC electric motor 50 (best shown in FIG. 3) which drives a gear wheel 52 meshing with a drive gear 54 connected to the shaft 56 of the first roller 46. The motor 50 thus forms a means for driving the first roller 46 to transport moistening fluid from the reservoir 30 to material of the web 12 which in use contacts a second surface region 58 of the first roller spaced from the first region 48. A second roller 60 is provided to press the web of material onto the first roller 46. When inserting a new roll 12 of material into the dispenser the leading edge 66 of the first turn of paper (FIG. 2) is pulled downwardly over and in front of the tear-off fins 64 or serrations. When the hood 68 is pivoted outwardly as shown in FIG. 1, in which it is pivoted outwardly and downwardly about a pivot axis such as pin 70 in FIG. 4 a wide gap forms between the inboard end of the hood and the reservoir and the leading edge 66 of the roll of paper 12 can be directed through this gap and through a slot 72 in the hood 68. The pin 70 can be a through going pin or two separate pins engaging the left and right sides of a carrier member 74 for the reservoir 30, the carrier member 74 being connected to the support member 20 at 76.

Figure 4:
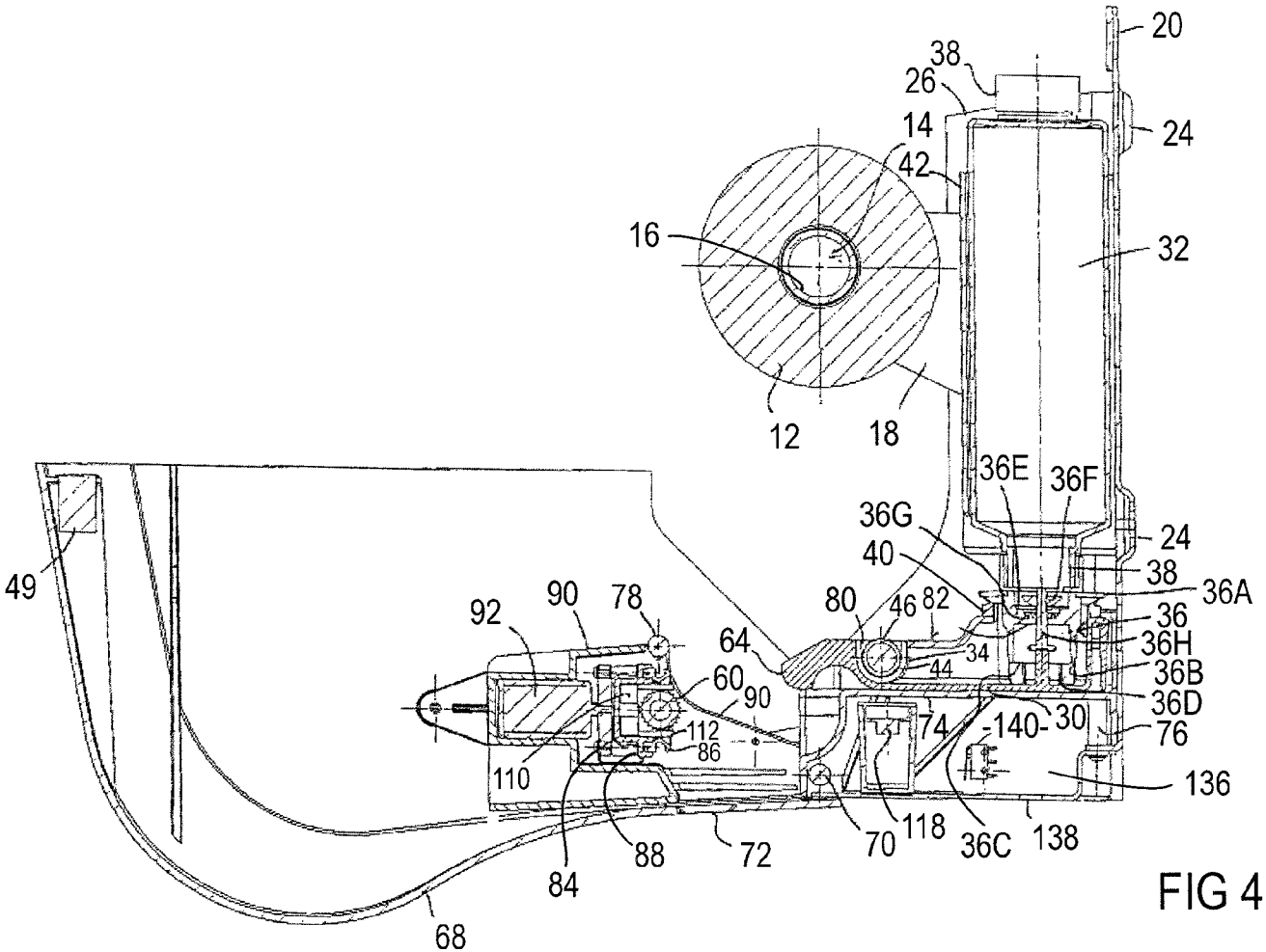
FIG. 4 shows a section on the section plane IV-IV of FIG. 3 but with the hood swung downwardly into the position shown in FIG. 1.
Figure 5:
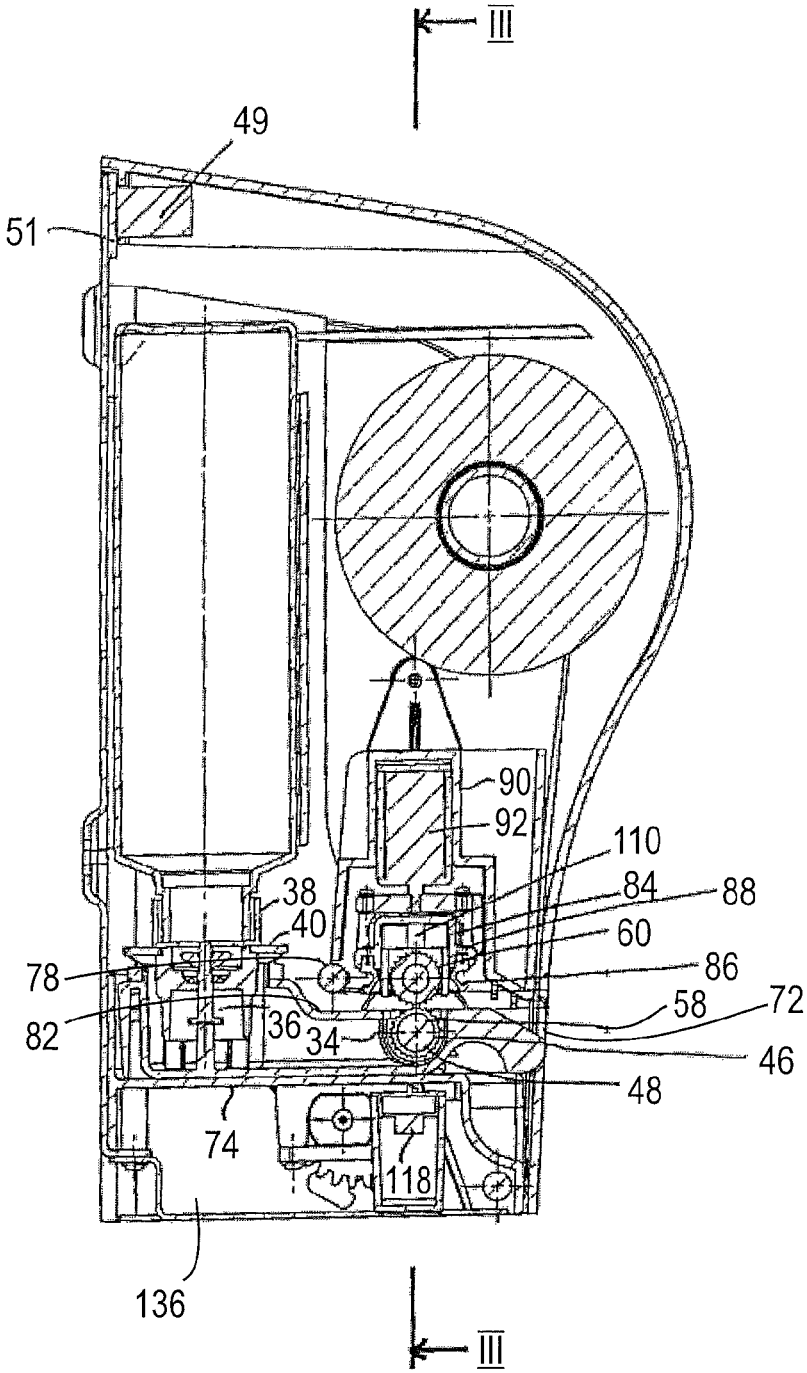
FIG. 5 shows a section on the section plane V-V of FIG. 3 with the hood swung upwardly.

When the hood member 68 is swung upwardly into the position shown in FIG. 5 the rounded rear deflection edge 78 pushes the web of material 12 towards the tank 32 behind the first roller 46 in FIG. 1, catch 49 (FIG. 4, FIG. 5) enables the hood 68 to be latched or locked in the closed position by engagement with the counter latch 51. In use of the dispenser 10, a section of the material (not shown) overlies an opening 80 in a wall 82 of the reservoir 30 and contacts the second surface region 58 and the second roller 60, which can readily be seen in FIGS. 4 and 5.

Figure 3:
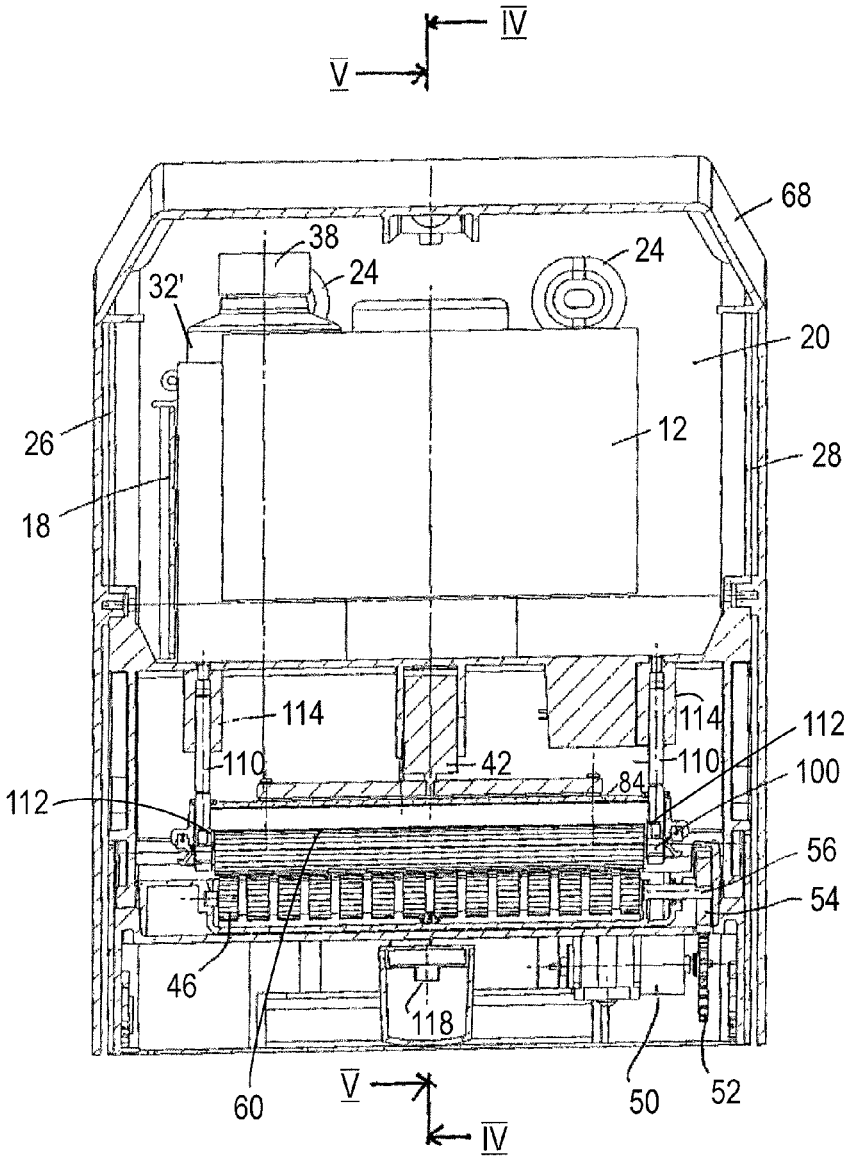
FIG. 3 shows a section of the apparatus of FIG. 2 generally in the plane III-III but with the hood and the components attached thereto swung upwardly into the operative position.

The second roller 60 is disposed in a housing 84 adapted to seal against the wall 82 of the reservoir around the opening 80 by means of a peripherally extending lip seal 86 attached in a groove 88 in the base of the housing as can best be seen from FIG. 3. The second roller 60 presses the section of material into contact with the second surface region 58 and the material is engaged by the housing 84 or more specifically by the lip seal 86 and by the wall 82 upstream and downstream of the opening 80 with a force permitting the transport of the material between the housing and the wall on driving of the first roller 46.

By incorporating the second roller 60 in the housing 84 which, in this embodiment, is carried by the hood 68 covering the supply of material 12 and pivotable away from the support member 20 about a horizontal axis defined in this example by the pins 70, it is possible to open the dispenser 10 to allow a length of the material to be placed behind the hood 68 in front of the reservoir, typically in the vertical gap between the first and second rollers 46 and 60 and between the housing 84 and the wall 82 of the reservoir 30 so that, on shutting the hood 68 again, the housing 84 essentially seals the reservoir 30 relative to the outside environment. As noted earlier the hood 68 typically has a rounded edge 78 or a roller acting as a deflecting member for the material on its path from the supply 12 to the nip formed between the first and second rollers 46, 60 when the hood 68 is closed. This path can for example change from a generally vertical direction upstream of the deflecting member 78 to a generally horizontal direction downstream thereof in the run-in to the nip.

The only path which is theoretically available for the escape of volatile fluid in vapour form is through the pores or interstitial spaces of the thin material strips upstream and downstream of the opening 80 in the wall 82 of the reservoir 30. However, it has surprisingly been found that, even with modest pressure of, for example, one Newton to five or ten Newtons for a material width of 200 mm, the housing 84 seals so well against the wall 82 of the reservoir 30 and against the material 12 that the fluid losses are negligibly small. Nevertheless, the ability to dispense the material 12 between the housing 84 and the wall 82 of the reservoir 30 on driving the first roller 46 is maintained.

The hood 68, which could also be another part separate from a cover for the roll of material 12, has a carrier member 90 adapted to carry the housing 84. and means, expediently in the form of a solenoid 92, connects the housing 84 to the carrier member 90, as can best be seen in FIGS. 3 and 5. The solenoid 92 is provided for generating relative movement between the housing 84 and the carrier member 90 for urging the housing 84 into contact with the wall 82 of the reservoir 30.

To generate the nipping force between the housing 84 and the wall 82 of the reservoir 30 the solenoid 92 is preferably adapted to resiliently urge the housing 84 into engagement with the wall 82 of the reservoir 30 with a predetermined force. Such a solenoid 92 can be a type of solenoid known per se having two rest positions for its armature at least one of which is resilient but both of which are stable positions when the solenoid 92 is not electrically energised. Electrical energisation is only required to move the armature between the two rest positions. This saves power consumption when the dispenser is in a waiting mode (waiting for a user to require the issue of a further length of moist wipe material 12) and contributes to permitting battery operation of the dispenser 10, which could however alternatively be fed from a mains power supply if required.

Figure 6:
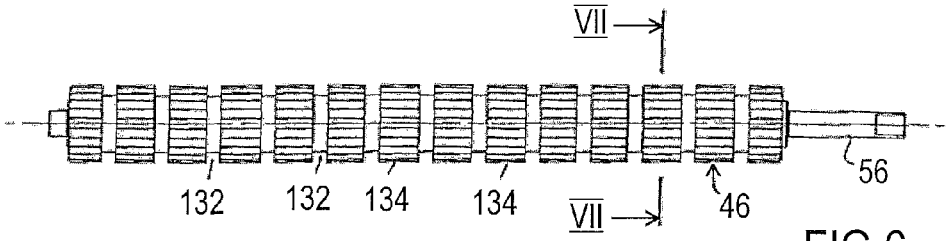
FIG. 6 shows a plan view of the roller for transporting fluid in the apparatus of FIGS. 1 to 5.
Figure 8:
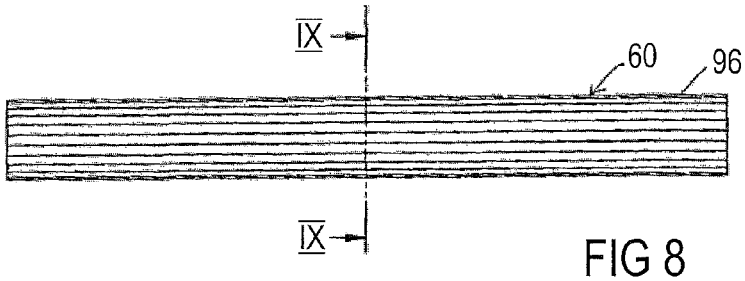
FIGS. 8 and 9 show figures similar to FIGS. 6 and 7 but illustrating the counter-roller which cooperates with the fluid transport roller of FIGS. 6 and 7.
Figure 7:
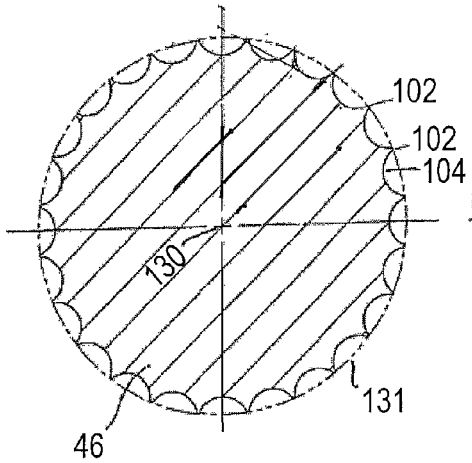
FIG. 7 shows a cross-section through the roller of FIG. 6 on the section plane VII-VII.
Figure 9:
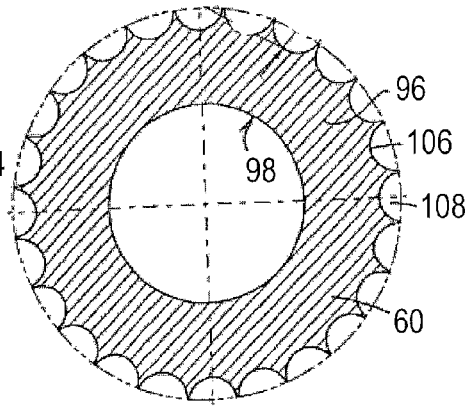

The first roller 46 is preferably a fluted roller, in particular a fluted roller designed as explained later in relation to FIGS. 6 and 7 and the second roller 60 is preferably a roller of resilient material such as silicone having an external shape substantially complementary to that of the first roller 46. The silicone material is conveniently provided as a sheath 96 having a longitudinal cylindrical passage 98 at its centre for mounting the sheath on a shaft 100 visible in FIG. 3. Such a design ensures that fluid cannot pass from the level 34 of the reservoir 30 to the material 12 when the rollers 46, 40 are stationary but only when the first 46 and second rollers 60 are rotating. Moreover, the nipping of the material 12 between the peaks 102 of the flutes 104 of the first roller 46 and the bases 106 of the corresponding flutes 108 of the second roller 60 can as shown in FIGS. 7 and 9 be exploited to prevent wicking of the fluid into the material 12 when the rollers 46, 60 are rotating and the first roller 46 carries fluid upwardly in its flutes 104 to moisten or wet the web of material 12.

In some cases, depending on the nature of the material 12 to be moistened it is expedient to provide a means for urging the second roller 60 in the direction towards the first roller 46. One convenient design of such a means shown in FIG. 3 comprises spring-loaded plungers 110 extending in sealed manner through the housing 84 and contacting bearing holders 112 for the ends of the shaft 100 of the second roller 60, the bearing holders 112 being displaceably mounted. More specifically the plungers 110 attach to the bearing holders 112 at their lower ends and are free to slide at their upper ends in FIG. 3, in cylindrical holders 114 of the carrier member 90. The springs are compression coil springs (not shown) disposed in the cylindrical holders 114 of the carrier members 90 and braced at one end against the carrier member 90 (or against the ends of bores in the cylindrical holders 114) and at their other end against the respective plunger 110. The spring loaded plungers 110 also help stabilise the position of the housing 84 within the carrier member 90.

Although the material 12 is present here in the form of a roll 12 it could also be present in a different form such as material in fan-fold form, material in web form with or without perforations, a web of material having notches cut-outs, marks and/or markings at one or more side regions thereof and at substantially uniform intervals and material in discrete sheet form, optionally with perforations at the side for sheet feeding. Material in roll form is preferred since this is easy to handle.

It is also convenient if the material 12 comprises a continuous web of material, for it to have perforations, cut-outs (for example as shown at 116 in FIG. 1), marks or markings at predetermined intervals in at least one marginal region of the web. In this case the dispenser 10 has at least one detection sensor adopted to detect the cut-outs, perforations, marks or markings and to trigger the motor 50 provided to drive the first roller 46 to stop further transport of the web of material 12. This greatly simplifies the design of the electronic control circuitry for driving the motor 50 used to drive the first roller 46. The drive motor 50 can namely be started by a trigger signal received when an operator places his hand in an issue region for the moist wipe material 12 and stopped when the next cut-out 116, perforation mark or marking reaches the detection sensor, which sends a stop signal to the motor 50. By predetermining the spacing of the cut outs, perforations, marks or markings along the web of material 12 a desired preset length of moist wet wipe material 12 can be reliably issued. If the operator requires more waste wipe material 12 he can reach again into the field of view of the sensor 118 (FIG. 3) issuing the trigger signal to start the issuing process again.

It is also possible to provide a series of closely spaced cut-outs, perforations, marks or markings and to be able to program the control to issue any desired multiple of a basic length of moist wipe material 12. A basic dispenser 10 can thus easily be programmed to suit an individual operators needs. Such a system can also be used to carry out a progressive count of the lengths of moist wipe material 12 issued and thus to estimate when the supply of material 12 will require replenishing and to issue a warning of some kind, for example to light up a red diode alerting the operator of the need to replenish the supply.

Thus the dispenser 10 includes a sensor 118 disposed in the area of issue of the material 12 from the dispenser 10 and adapted to detect the presence of a hand or of hands of an operator and to start the motor provided to drive the first roller 46 to transport the material 12 towards the operator.

The first roller 46 can either be driven directly or, as shown, via a gear 54 located outside of the reservoir 30 and attached to the shaft 56 of the first roller 46 extending through a seal into the reservoir 30. Alternatively the first roller 46 can be driven indirectly via the second roller 60. In this case the second roller 60 would be connected directly or via a transmission to a motor 50 disposed exterior to the reservoir 30.

The fluted roller 46 which is preferably used has already been outlined above. It has longitudinal grooves or flutes 104 arranged at regular angular intervals around the roller preferably generally parallel to the axis 130 thereof, with adjacent grooves 104 (flutes) merging into one another at longitudinal peaks 102 of the fluted roller 46, with each groove or flute being of generally arcuate shape at its base between each adjacent pair of peaks 102.

In a preferred embodiment the fluted roller preferably has an outer diameter in the range between 10 and 25 mm, preferably between 12 and 18 mm and in particular of approximately 15 mm, the number of grooves is expediently selected to lie in the range between 6 and 60, in particular between 18 and 36 and is preferably approximately 24. The arcuate bases of the grooves having a radius in the range from 0.5 mm to 3.0 mm and/or the individual grooves or flutes 104 can have a maximum depth measured radially from an imaginary pitch circle 131 on which the peaks 110 between the flutes 104 lie to the base of the grooves of 0.5 to 1.0 mm, preferably 0.7 mm. The included angle of each peak 110 of the fluted roller 46 measured between the tangents to each side of each peak 110 expediently lies in the range from 20° to 30° and in particular at 27°. The second roller 60 is of generally complementary shape but optionally with a diameter different from that of the first roller 46 and with a radial depth of each groove of the second roller 60 being greater than the corresponding depth of each groove of the first roller 46, for example by an amount in the range from 0.2 mm to 0.6 mm.

Finally, the fluted roller 46 can expediently be provided with radially extending grooves 132 arranged at intervals along the length of the first roller 46 and separating sections such as 134 of longitudinal grooves having the described shape. This embodiment makes it possible to control the amount of moistening fluid used to moisten the moist wipe material 12 for a given speed of rotation of the first roller 46. Surplus fluid namely collects in the grooves and drips back into the reservoir 30 for reuse.

It is noted that the dispenser is preferably battery driven. Tests have shown that a conventional 9V battery block will provide sufficient capacity for at least nine months use of the dispenser 10. Tests have also established that the loss of propanol in a 50/50 propanal/water solution is so minimal that it can be ignored.

Figure 4A:
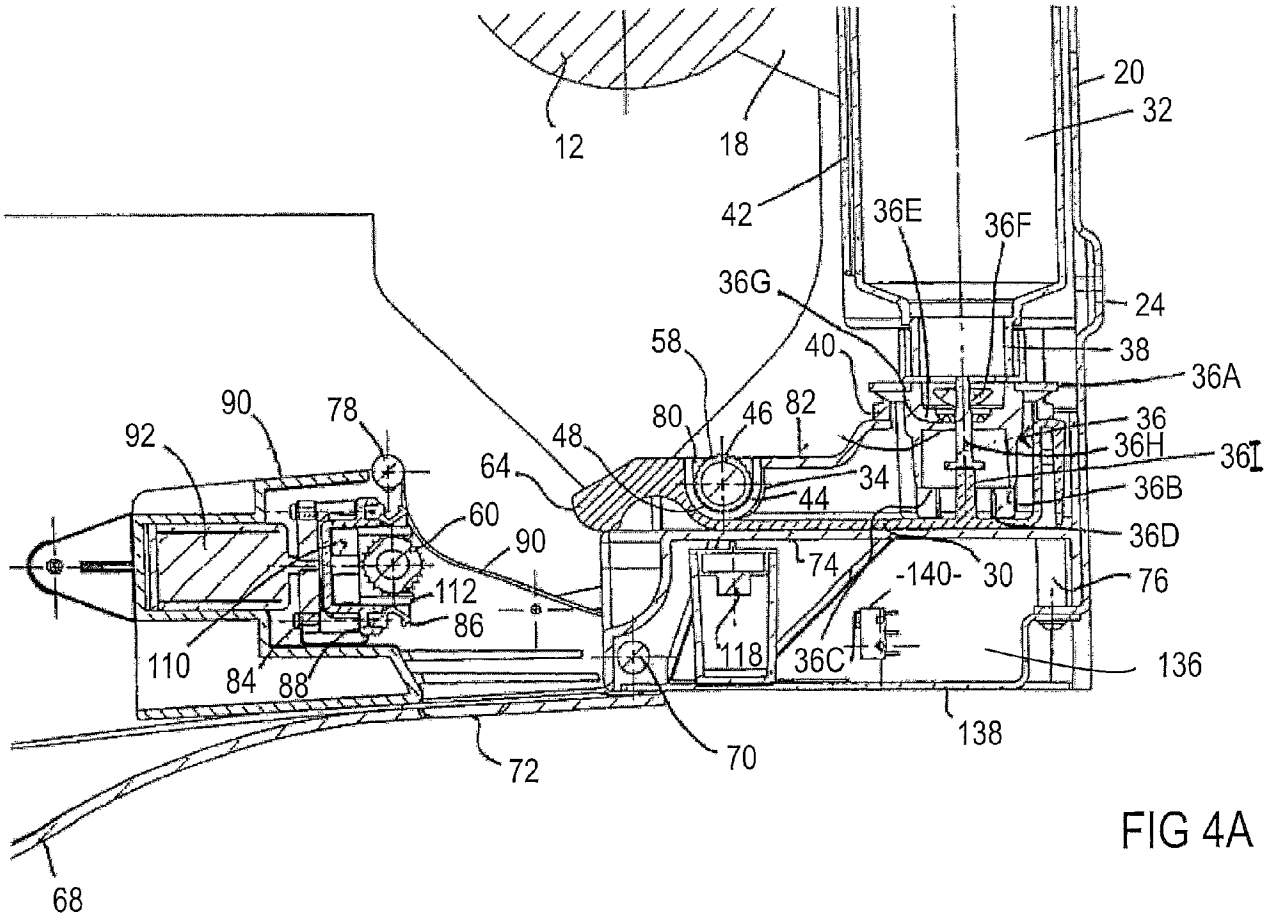
FIG. 4A shows the detail of the area around the valve in FIG. 4.

Finally it is noted that all the electronics for the sensors such as 118 that are provided and the motor 50 as well as its control circuit and any mains power supply and rectifier are preferably and conveniently stored in the dispenser 10, for example in the space 136 shown in FIG. 4 below the reservoir 30 inside the carrier part 74 and above the floor panel 138. The reference numeral 140 refers to a microswitch which first switches on the dispenser 10 when the hood 68 is closed.

Figure 10:
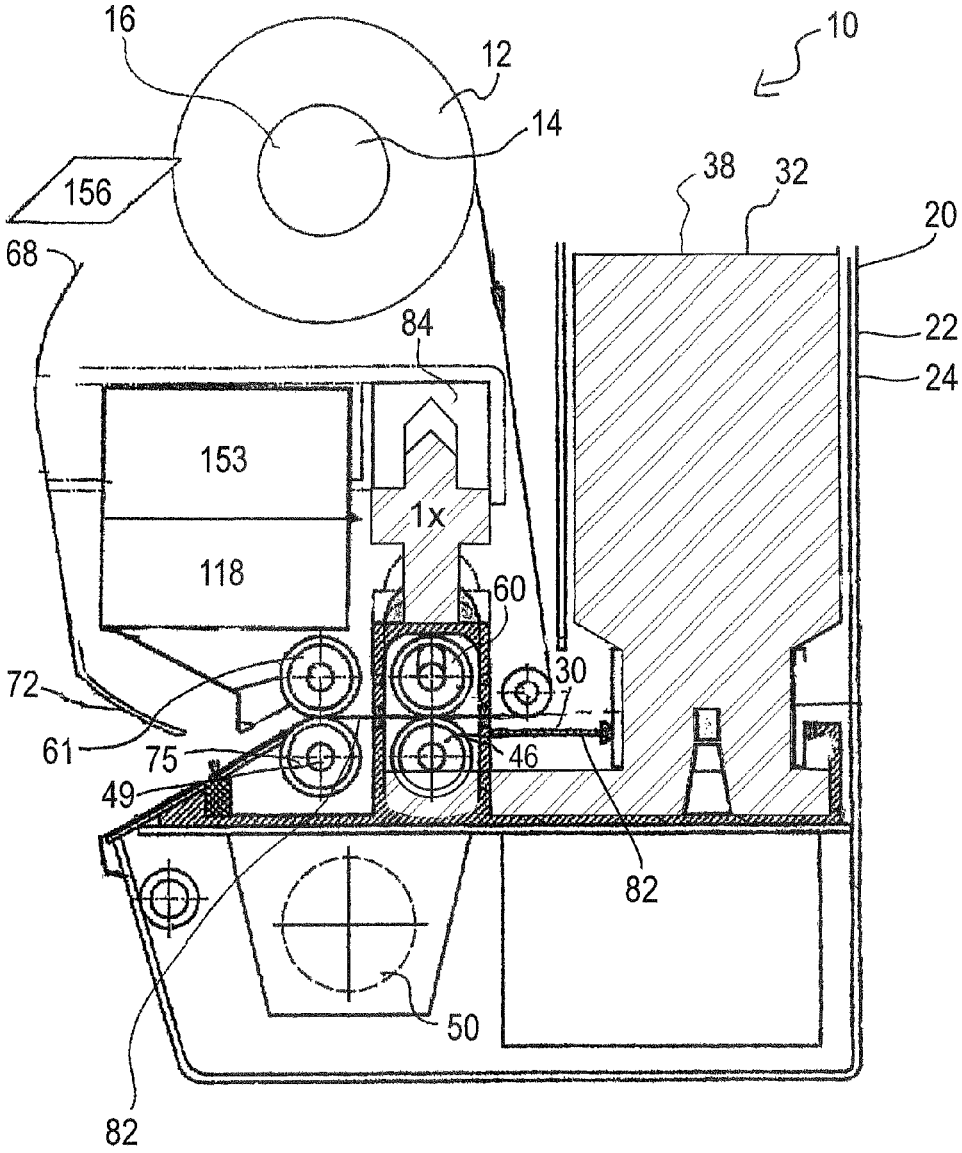
FIG. 10 shows a partly sectioned side view of a further dispenser in accordance with the invention.

Turning now to FIGS. 10 to 15 and in particular to FIG. 10, there are shown various views of an alternative dispenser 10 for moist wipe material. This dispenser differs from that of FIGS. 1 to 9 essentially only in that two pairs of rollers are used as will become apparent from the following.

Figure 11:
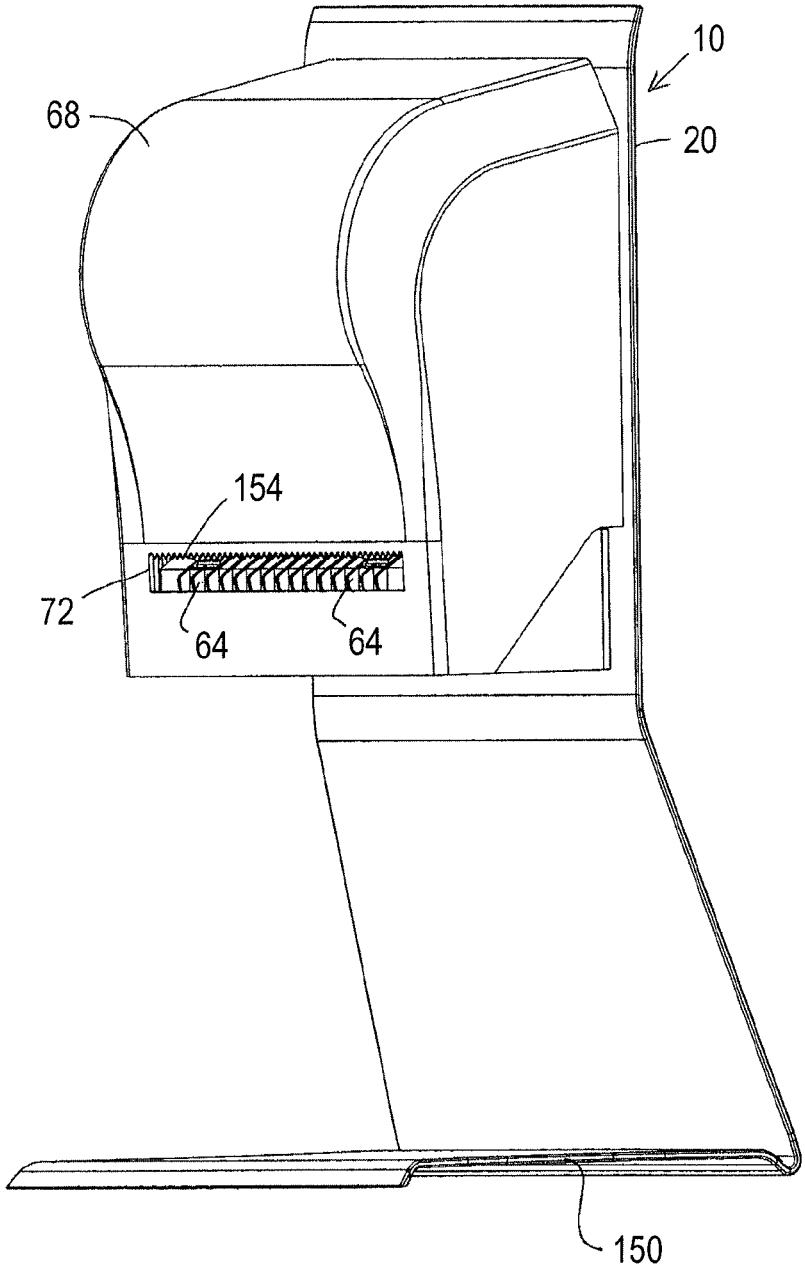
FIG. 11 shows a perspective view of a dispenser in accordance with the invention.

The moist wipe material 12 is initially present in the form of a roll of dry paper 12 present on a holder 14 and is subsequently moistened/wetted with fluid from the reservoir 30. The holder 14 is formed by a tube member 16 secured to a bracket 18 (not shown here, but shown in the embodiment of FIG. 12) in the form of a plate which is secured (optionally pivotably secured about a vertical axis for easy access) to a support member 20 forming the backbone of the dispenser 10. The support member 20 in this embodiment takes the form of a stainless steel plate which has a back part 22 with holes 24 for mounting the dispenser on a wall. It should be noted that this design of the support member is just one possible arrangement. Instead of using a stainless steel plate or pressing it could be a plate or pressing of another metal, optionally in powder coated form, or an injection molded plastic part or simply a frame. The precise shape is simply a matter of choice and expediency. Another possibility as shown in FIG. 11 and the related drawings of the further FIGS. 12 to 15. There the support member 20 is provided with a horizontal base portion so that the dispenser can stand on a table or the like as shown in FIG. 11.

The internal details of the embodiments of FIGS. 10 and 11 are essentially the same and reference will now be made to all FIGS. 10 to 15 in the following and it will be understood that the description given applies equally to the two embodiments.

In this particular embodiment a display 156 (FIG. 10) is mounted in the cover 68, which can display the type of moistening liquid included in this dispenser 10. The moistening fluid can, for example, comprise any one of an alcohol/water mixture for sterilization purposes, a sterilizing medium, a solvent for cleaning purposes, a brake cleaning medium, a paint cleaning medium, a cleaning medium for any other purposes and a cosmetic medium, the cosmetic medium and/or the cleaning medium including scented and/or perfumed mixtures.

Also shown in FIG. 10 is a controller 153, which is adapted to control the motor 50 to feed the material 12 though the two sets of rollers 46, 60 and 47, 61, and the controller 153 can also be adapted to communicate with the display 156 to communicate that either the material 12 or the moistening fluid or the battery to supply electrical power to the dispenser are reaching a critically low level needed for operation of the dispenser 10.

The second set of rollers 47, 61 is arranged within the dispenser 10 downstream of the first set of rollers 46, 60 and outside of the liquid reservoir 30, to securely guide the material 12 from the first set of rollers 46, 60 (in an advantageous embodiment also via a second set of rollers 47, 61) to the slot 72 in the housing 84 after the material 12 has been moistened.

FIG. 11 shows a general perspective view of the dispenser 10 for moist wipe material as shown in more detail in FIGS. 12 to 15. The moist wipe material 12 is initially present in the form of a roll of dry paper 12 present on a holder 14 (see FIG. 12) and is subsequently moistened/wetted. The holder 14 is formed by a tube member 16 secured to a bracket 18 (see FIG. 12) in the form of a plate which is secured to a support member 20 forming the backbone of the dispenser 10. The support member 20 in this embodiment is provided with a horizontal base portion 150 so that the dispenser can stand on a table or on any other generally flat surface. Clearly visible on the front of the dispenser 10 is the slot 72 where the material 12 is dispensed and can be torn off via the tear off fins 64 and/or serrated teeth 154.

The example of a dispenser 10 shown in FIG. 11 consists of a stainless steel housing (hood 68), and is just exemplary in shape and size. The width can be approximately 19 cm and can e.g. vary from 12 cm to 30. The height of this particular housing is approximately 28 cm and can e.g. vary from 15 cm to 50 cm, depending on the type of application. The housing may be any type of material which is suitable for containing the paper material, e.g. different types of plastic, different types of metal alloys such as aluminum based materials and/or steel based materials and the like.

Figure 12:
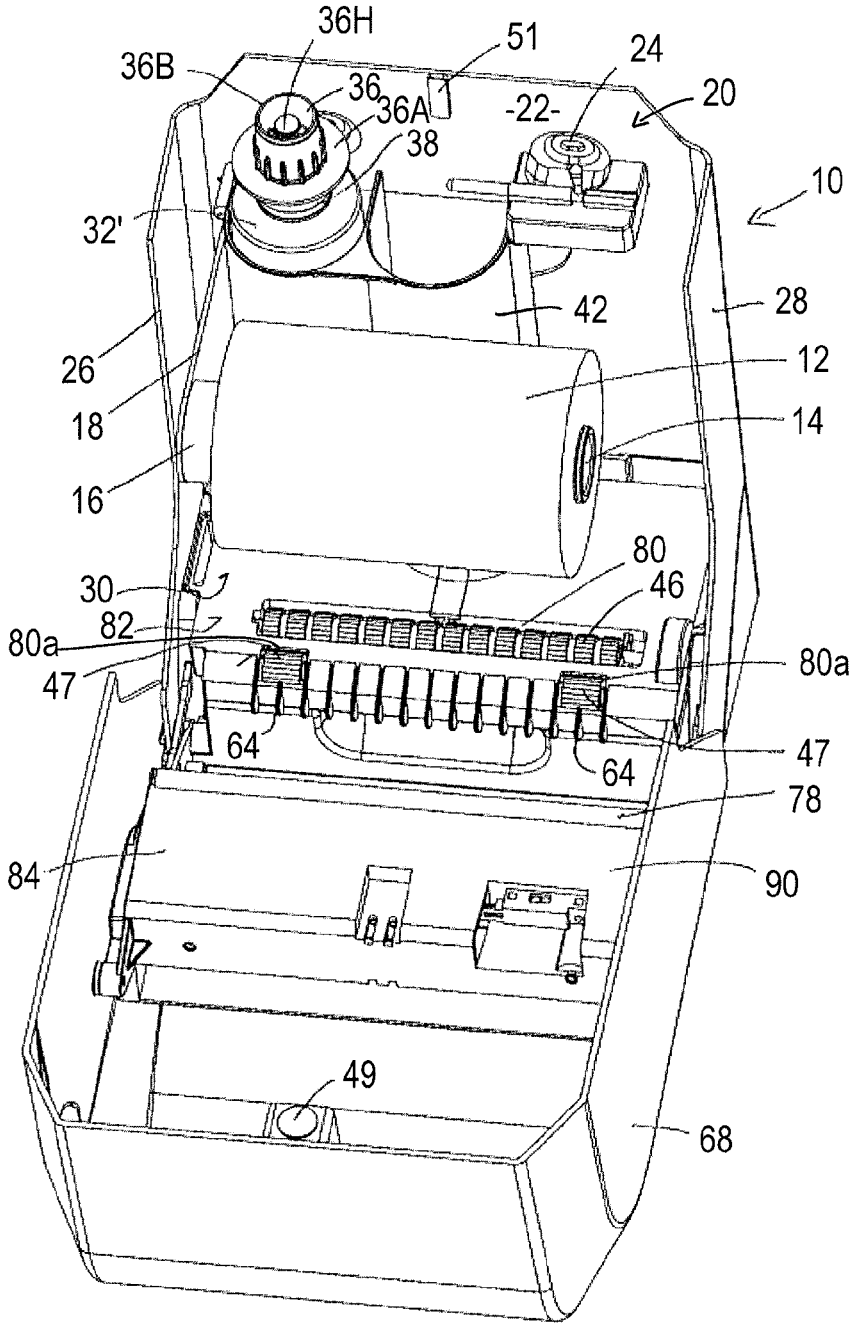
FIG. 12 shows a further perspective view of a dispenser in accordance with FIG. 11, with an open cover.

FIG. 12 shows a drawing of the open dispenser 10 with material 12 installed on the material holder 14. Only a single tank 32 is presently fitted into the dispenser 10 and indeed in the reserve position. To the right of this tank there is another receiver into which the reserve tank can be placed inverted in order to feed fluid liquid into the reservoir 30 as will be discussed shortly. The cover 68 can be pivoted about a carrier member 90 adapted to carry the cover 68 and means are provided for generating relative movement between the housing 84 and the carrier member 90 for urging the housing 84 into contact with the wall 82 of the reservoir 30.

Figure 13:
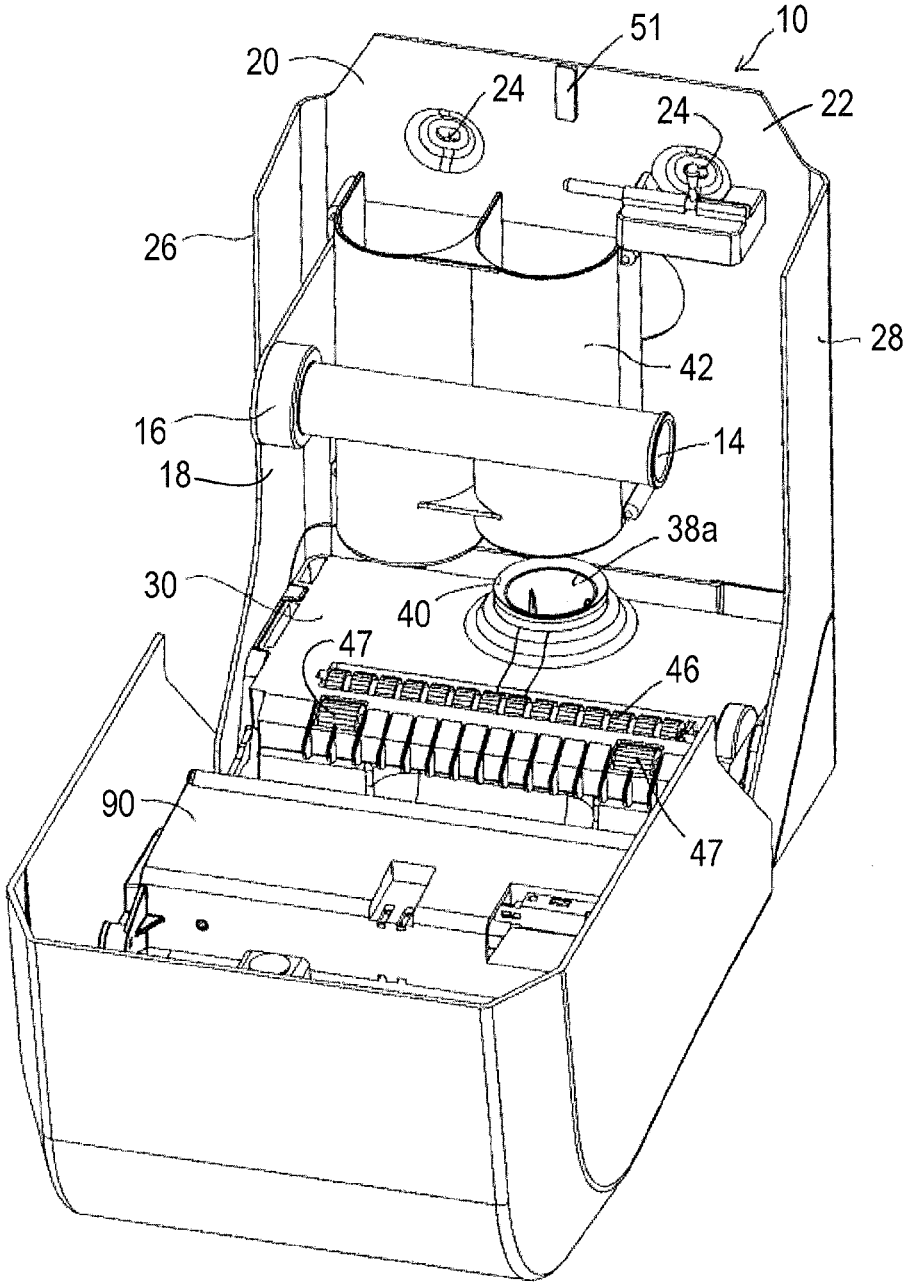
FIG. 13 shows a further view of a dispenser in accordance with FIG. 11, partly in perspective.

FIG. 13 shows a view of the open dispenser 10 prior to the installation of the material 12 on the holder 14 and the reserve and operating tanks 32', 32 to their positions in the separate holders 42. The reservoir 30 with the first roller 46 of the first set and the further first roller 47 of the second set is still to be installed, so that the cylindrical neck receiver 38 a of the reservoir 30 can receive the neck 38 of the operating tank 32, containing the moistening liquid for the reservoir. At the end of the tank 32 there is a valve 36 which opens automatically to replenish the level of fluid in the reservoir when this drops below a certain level. The design and operation of the valve is precisely the same as that of the valve described with reference to FIG. 4.

Figure 14:
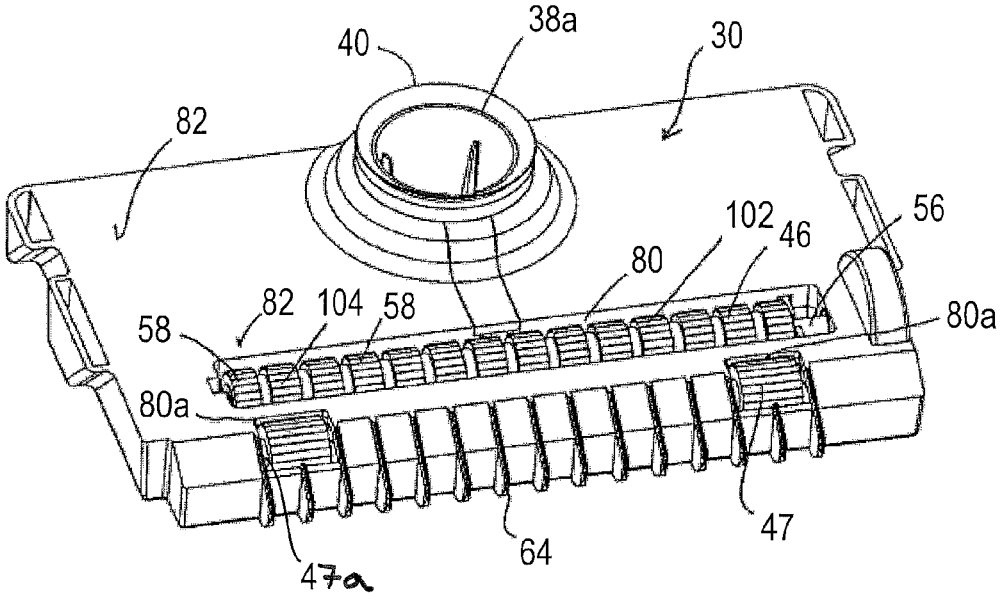
FIG. 14 shows a view of a reservoir in accordance with the invention as used in the embodiments of FIGS. 10 and 11.

FIG. 14 shows a view of the top wall 82 of the reservoir 30. Clearly visible are a cylindrical neck receiver 38*a* and a lip seal 40, which receive the cylindrical neck 38 of the tank 32 which sealingly engages with the lip seal 40 surrounding the valve arrangement 36 in the base of the reservoir so that no fluid can leak out of the tank. Also shown is the first roller 46 embedded in a trough 80 of the wall 82. Also shown is the further roller 47 formed in a further trough 80*a* which present in the wall 82 of the reservoir just upstream of the tear-off fins 64. In this particular embodiment the further first roller 47 consists of two separate rollers fixedly rotatably connected to a roller axle 47*a*. The first further roller 47 shown in FIG. 14 can also consist of a single continuous roller or be equivalent to the first roller 46 or the second roller 60 (see FIGS. 6, 8 and 15). This further first roller 47 is implemented to better guide the material 12, once this has been in contact with the moistening fluid of the reservoir 30 at the first roller 46.

The profiles and design of the second set of rollers 47, 61 can be conveniently be the same as or similar to the first set of rollers as described in connection with the embodiment of FIGS. 1 to 9.

Figure 15:
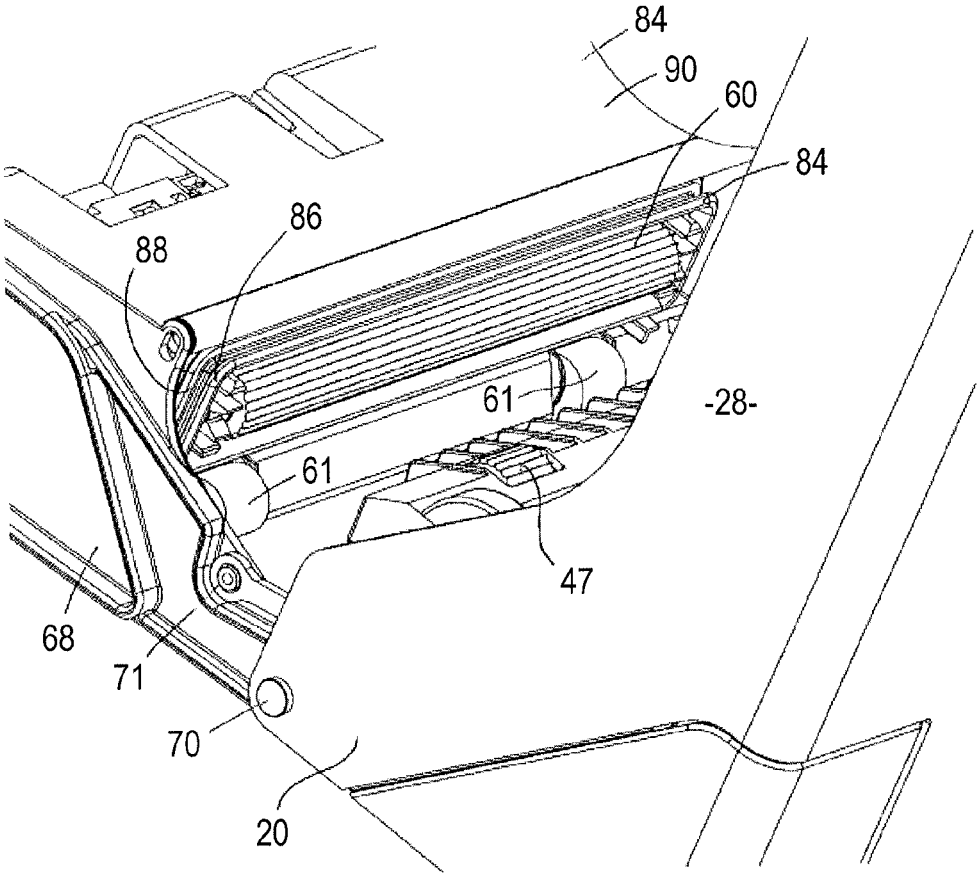
FIG. 15 shows a view of the second roller in accordance with the invention as used in the embodiments of FIGS. 10 and 11.

FIG. 15 shows a detailed view of the second roller 60 which is rotatably disposed in the carrier member 90 and extends generally parallel to the roller 60 disposed in the housing 84. The housing 84—which is pivoted at axle 71 in FIG. 15—is adapted to seal against the wall 82 of the reservoir around the opening 80 (when the hood 68 is closed and the housing 84 swung into place about the axle 71) by means of a peripherally extending lip seal 86 attached in a groove 88 in the base of the housing as can best be seen from FIG. 15. The second roller 60 presses the section of material into contact with the second surface region 58 (FIG. 14) and the material 12 (FIG. 12) is then engaged by the housing 84 or more specifically by the lip seal 86 and by the wall 82 upstream and downstream of the opening 80 (see FIG. 14) with a force permitting the transport of the material between the housing and the wall on driving of the first roller 46. Also shown is the further second roller 61, which is complementary to the first further roller of FIG. 14, i.e. the further second roller 61 is in contact with the material 12 at the opposite surface of the material 12 at those points where the further first roller 47 is in contact with the material 12. In the embodiment shown here, the further second roller 61, consists of three separate rollers 61, but as the case may be this can be a single continuous roller 61 or a plurality of separate rollers 61. Moreover, means are provided to drive the first further roller 47 and/or the further second roller 61. These means may be the same means as those used to drive the first roller 46 and/or second roller 60 and if both sets of rollers are driven they are driven at the same surface speeds to avoid unnecessarily loading the moistened material.

Generally speaking it is sufficient to drive the first roller 46 and preferably also the first further roller 47 from a common stepping motor 50 and this is conveniently done either by mating gears and/or a toothed belt drive which ensures the rollers 46 and 47 move in a synchronised manner at the same surface speed to avoid tearing the moistened material. It is not necessary to drive the rollers 60 and 61 directly via gears or a toothed belt (although this could be done) because they are effectively driven by the form-fitted engagement with the first rollers 46, 47 through the intermediary of the material.

The invention claimed is:

1. A dispenser for dispensing moistened material, the dispenser comprising a support member carrying a holder for a supply of the material, a reservoir for a moistening fluid, a tank for dispensing moistening fluid into the fluid reservoir to maintain a desired level of fluid therein, a first roller disposed in the reservoir and having a first surface region dipping into the reservoir to a depth below said level, a means for driving the first roller to transport moistening fluid from the reservoir to material contacting a second surface region of the first roller spaced from said first region and a second roller for pressing some of the material onto the first roller, wherein, in use of the dispenser, a section of said material overlies an opening in a wall of said reservoir and contacts said second surface region and said second roller is disposed in a housing adapted to seal against said wall of said reservoir around said opening with said second roller pressing said section of material into contact with said second surface region and said material being engaged by said housing and said wall upstream and downstream of said opening with a force permitting the transport of said material between said housing and said wall on driving of said first roller, further wherein said first roller is a fluted roller having longitudinal grooves or flutes arranged at regular angular intervals around the roller and the longitudinal grooves or flutes extend generally in parallel to an axis of the fluted roller with adjacent grooves or flutes merging into one another at longitudinal peaks of the fluted roller, with each groove or flute being of generally arcuate shape at its base between each adjacent pair of peaks, wherein the second roller has a shape substantially complementary to that of the first roller and wherein the first roller and the second roller is arranged such that the longitudinal peaks of the flutes of the first roller and bases of the corresponding flutes of the second roller are aligned when the first roller and the second roller are rotating to prevent wicking of the fluid.

2. The dispenser in accordance with claim 1, wherein said second roller is a roller of resilient material having a shape substantially complementary to that of said first roller.

3. The dispenser in accordance with claim 1, wherein said material is present in the form of one of the following: a roll material, material in fan-fold form, material in web form with or without perforations, a web of material having at least one of notches, cut-outs, and printing marks at one or more side regions thereof and at substantially uniform intervals and material in discrete sheet form.

4. The dispenser in accordance with claim 1, wherein said wall of said reservoir is a top wall.

5. The dispenser in accordance with claim 1, and including a part covering the supply of material and pivotable away from the support member, said part having a carrier member adapted to carry said housing and in that means is provided for generating relative movement between said housing and said carrier member for urging said housing into contact with said wall of said reservoir.

6. The dispenser in accordance with claim 1, further comprising a solenoid adapted to urge said housing into engagement with said wall of said reservoir with a predetermined force.

7. The dispenser in accordance with claim 1, further comprising means for urging said second roller in the direction towards said first roller.

8. The dispenser in accordance with claim 7, said means for urging comprising spring-loaded plungers extending in sealed manner through said housing and contacting said second roller.

9. The dispenser in accordance with claim 1, wherein said material comprises a web of material having perforations, cut-outs, or printing marks at predetermined intervals in at least one marginal region of the web and in that the dispenser has at least one optical detection system adopted to detect the cut-outs, perforations, or printing marks and to trigger said means for driving said first roller to stop further transport of said web of material.

10. The dispenser in accordance with claim 1, further comprising a sensor is adapted to detect the presence of a hand or of hands of an operator and to start said means for driving said first roller to transport said material towards said operator.

11. The dispenser in accordance with claim 10, wherein said sensor is disposed in the area of issue of said material from said dispenser.

12. The dispenser in accordance with claim 1, wherein said first roller is driven directly via a gear located outside of said reservoir and attached to a shaft of said first roller extending through a seal.

13. The dispenser in accordance with claim 1 wherein said first roller is driven indirectly via said second roller, said second roller being connected directly or via a transmission to a motor disposed exterior of said reservoir.

14. The dispenser in accordance with claim 1, wherein said moistening fluid comprises any one of an alcohol/water mixture for sterilization purposes, a sterilizing medium, a solvent for cleaning purposes, a brake cleaning medium, a paint cleaning medium, a cleaning medium for any other purpose and a cosmetic medium.

15. The dispenser in accordance with claim 1, wherein the first roller and the second roller form a first set of rollers and wherein a second set of rollers is arranged within the dispenser to securely guide the material from the first set of rollers to a dispensing slot after the material has been moistened.

16. The dispenser in accordance with claim 1, wherein said fluted roller further comprises radially extending grooves arranged at intervals along the length of the fluted roller and separating sections of longitudinal flutes or grooves.

17. The dispenser in accordance with claim 1, wherein the fluted roller has an outer diameter in the range between 10 and 25 mm.

18. The dispenser in accordance with claim 1, wherein the number of grooves or flutes is expediently selected to lie in the range between 6 and 60.

19. The dispenser in accordance with claim 1, wherein the arcuate bases of the grooves or flutes have a radius in the range from 0.5 mm to 3.0 mm.

20. The dispenser in accordance with claim 1, wherein the individual grooves or flutes have a maximum depth measured radially from an imaginary pitch circle on which the peaks between the flutes lie to the base of the grooves of 0.5 to 1.0 mm.

21. The dispenser in accordance with claim 20, wherein the included angle of each peak of the fluted roller measured between the tangents to each side of each peak lie in the range from 30° to 20°.

22. The dispenser in accordance with claim 1, wherein the first roller is configured to transport moistening fluid from the reservoir to the material contacting the second surface region of the first roller.

* * * * *